US012196078B1

(12) United States Patent
Egbeni et al.

(10) Patent No.: US 12,196,078 B1
(45) Date of Patent: Jan. 14, 2025

(54) SALINITY AS A DE-RISKING TOOL FOR CARBON CAPTURE

(71) Applicant: Saudi Arabian Oil Company, Dhahran (SA)

(72) Inventors: Sylvester Egbeni, Dhahran (SA); Ahmed Al Ghamdi, Dhahran (SA); Ibrahim M. Hanbal, Dhahran (SA); Fahad R. Khateeb, Dammam (SA); Sara A. Jazzar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/428,715

(22) Filed: Jan. 31, 2024

(51) Int. Cl.
*E21B 49/08* (2006.01)
*E21B 41/00* (2006.01)

(52) U.S. Cl.
CPC ..... *E21B 49/0875* (2020.05); *E21B 41/0064* (2013.01)

(58) Field of Classification Search
CPC ..... E21B 49/0875; E21B 41/0064
See application file for complete search history.

(56) References Cited

U.S. PATENT DOCUMENTS 11,353,443 B2 6/2022 Howard et al.
11,353,621 B2 6/2022 Khan et al.
2013/0158874 A1* 6/2013 Helber ..... G06Q 10/00 702/5
2014/0278314 A1* 9/2014 Jacobs ..... G06F 30/20 703/9
2019/0323344 A1* 10/2019 Garcia ..... G01V 3/26
2022/0324737 A1* 10/2022 Ozair ..... C02F 9/20

FOREIGN PATENT DOCUMENTS

CA 2666947 4/2016
CA 2753402 8/2016

OTHER PUBLICATIONS

Applicability of Hydrocarbon Subsurface Workflows to CCS, Geological Society of London, Abstract Book, Apr. 28-29, 2022, 71 pages.

Asante, "Probabilistic Assessment and Uncertainty Analysis of $CO_2$ Storage Capacity of the Morrow B Sandstone," Energies, Nov. 2021, 14(22):7765, 19 pages.

(Continued)

*Primary Examiner* — Ricky Go
(74) *Attorney, Agent, or Firm* — Fish & Richardson P.C.

(57) ABSTRACT

The subject matter of this specification can be embodied in, among other things, a method that includes measuring a collection of salinity values representative of a depth within a saline aquifer and a salinity measurement value representative of salinity at the depth, determining, based on the collection of salinity values, a distribution of salinity across a plurality of depths within the saline aquifer, identifying, based on the distribution of salinity, a salinity gradient between a shallow region within the saline aquifer and a deep region within the saline aquifer, where the shallow region has salinity measurement values that are lower than salinity measurement values representative of the deep region, and determining, based on the identified salinity gradient, a sealing competency of the saline aquifer.

16 Claims, 7 Drawing Sheets

(56) References Cited

OTHER PUBLICATIONS

Bai et al., "Evaluating the Sealing Effectiveness of a Caprock-Fault System for $CO_2$-Eor Storage: A Case Study of the Shengli Oilfield," Geofluids, vol. 2017, Article ID 8536724, 17 pages.
Dai et al., "Uncertainty quantification for CO2 Sequestration and Enhanced Oil Recovery," Energy Procedia, 2014, 63:7685-7693 9 pages.
Han et al., "Dynamic Evaluation Method of Caprock Microscopic Sealing in $CO_2$ Sequestration Project," Geofluids, Article ID 2648692, 2020, 12 pages.
Jafaria et al., "Salinity effect on micro-scale contact angles using a 2D micromodel for geological carbon dioxide sequestration," Journal of Petroleum Science and Engineering, 2019 178, 152-161, 10 pages.
Jia et al., "A Caprock Evaluation Methodology for Underground Gas Storage in a Deep Depleted Gas Reservoir: A Case Study for the X9 Lithologic Trap of Langgu Sag, Bohai Bay Basin, China," Energies, Jun. 2022, 15, 4351, 23 pages.
Larkin et al., "Uncertainty in Risk Issues for Carbon Capture and Geological Storage: Findings from a Structure Expert Elicitation," Int. J. Risk Assessment and Management, (2019)22(3-4):429-463, 35 pages.
Lloyd, "Integrated Subsurface Characterization of a Basin-Scale Carbon Reservoir Target," Master's Thesis for the Degree of Doctor of Philosophy in the Faculty of Science and Engineering, University of Manchester, 2022, 266 pages.
Xia et a., "The Geological Risks of Exploring for a $CO_2$ Storage Reservoir" International Journal of Greenhouse Gas Control, Aug. 2017, 63:272-280, 33 pages.

* cited by examiner

SALINITY AS A DE-RISKING TOOL FOR CARBON CAPTURE

TECHNICAL FIELD

This instant specification relates to systems and techniques for evaluating the suitability of identified geological structures for use in carbon capture and sequestration.

BACKGROUND

Carbon capture, utilization, and storage (CCUS) is expected play a key role in global efforts to reduce emissions, while ensuring the world can continue to thrive. CCUS technologies capture carbon (e.g., carbon dioxide, CO2) emissions at source or directly from the air. The carbon is then transported away and stored deep underground indefinitely or turned into useful products.

Carbon sequestration in saline aquifers is a geological process that involves injecting carbon into subterranean voids such as exhausted wells and natural saline aquifers. Saline aquifers are deep geological formations made up of water permeable rocks that are saturated with salt water, called brine. A process called "dissolution storage" involves the dissolution of CO2 into the brine phase in a geochemical reaction for CO2 storage in saline aquifers.

However, not all saline aquifers are suitable for carbon sequestration. An aquifer that is not well sealed can permit carbon to escape. As such, the sealing integrity or "competence" of an aquifer is an important factor to consider when determining if the structure of a saline aquifer will be physically suitable for use in long-term carbon sequestration.

SUMMARY

In general, this document describes systems and techniques for evaluating the suitability of identified geological structures for use in carbon capture and sequestration.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method/the instructions stored on the non-transitory, computer-readable medium.

The subject matter described in this specification can be implemented in particular implementations, so as to realize one or more of the following advantages. First, a system can detect stratification of salinity levels in saline aquifers. Second, the system can determine sealing competence of the saline aquifers based on the detected stratification. Third, the system can predict the suitability of the saline aquifers for use in carbon sequestration. Fourth, the system can sequester carbon in aquifers that have been identified as being suitable for carbon sequestration.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

This document describes systems and techniques for evaluating the suitability of identified geological structures for use in carbon capture and sequestration. In general, data analysis of large datasets of geological information about saline aquifers was analyzed and demonstrated that fresher water with lower salinity is observed at the crest of the structure. In well-sealed aquifers, where the brine has remained undisturbed for millennia, relatively fresher portions of the brine will rise to the top (e.g., closer to the geological surface of the ground relative to gravity) while the relatively more saline dense portions of the brine will settle toward the bottom, with a substantially smooth vertical distribution of salinities in-between. The gradual change in salinity across depths can be called a salinity gradient or "salinity stratification."

The presence of smooth salinity gradients is indicative of a lack of leakage that would otherwise cause mixing of the distribution of salinity within the aquifer. As such, the presence of smooth salinity gradients and lack of leakage can be interpreted to indicate a competent top seal.

Leakage can cause currents or mixing within the aquifer that can disturb or prevent the settling of water of different saline densities. Sudden changes in the distributions of salinity within the aquifer, or a lack of salinity stratification (e.g., homogeneity of salinity distribution within the aquifer) can be indicative of leakage or a leaky top seal.

CO2 is more soluble in fresh water than saline water and thus dissolves better in fresh water than saline water. Very saline water has a high concentration of dissolved ions that reduces the capacity for CO2 to dissolve and be stored. As such, dissolved CO2 tends to migrate to the highest point in the structure.

Therefore, salinity measurements taken at or near the crest and the spill point of the container or trap can provide evidence of a leaky trap. Estimates of seal and trap competence and integrity can be used to estimate the risk, and in turn, the potential economic or environmental reward that the structure may provide as a location for carbon sequestration.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

Figure 1:
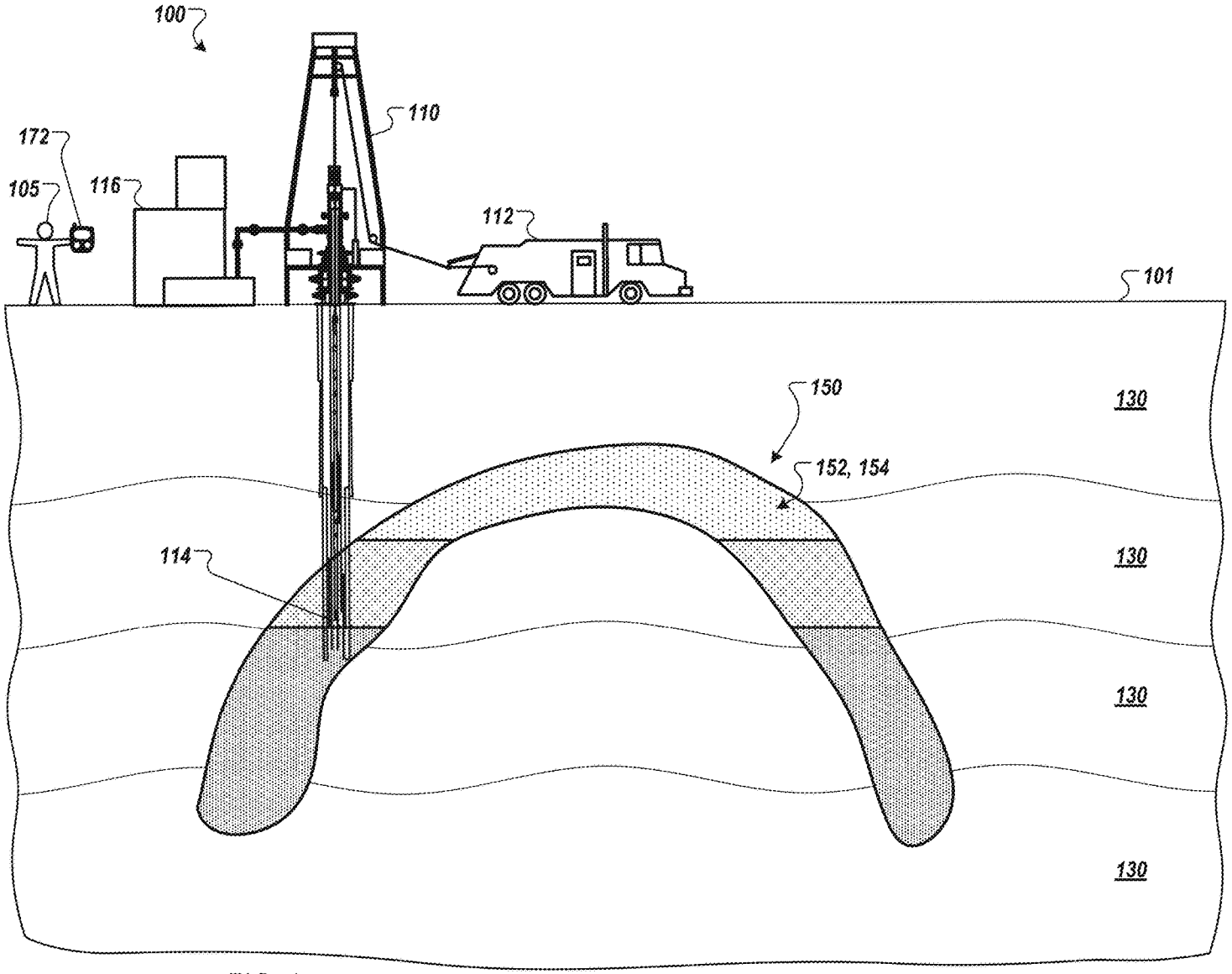
FIG. 1 is a conceptual sectional view of an example of a work zone with a subterranean saline aquifer.

FIG. 1 is a conceptual sectional view of an example of a work zone 100 with a subterranean saline aquifer 150. The work zone 100 extends across a portion of the Earth's surface 101 (e.g., an upper geological surface). At the surface 101, surface activities occur, such as the construction and operation of a drilling rig 110 or related equipment, the use of vehicular equipment 112, operation of a measurement tool 114, and operation of a carbon sequestration system 116 or related equipment.

Below the surface 101 are various layers 130 of rock, soil, sand, and other geological materials. Formed within the various layers 130 is the saline aquifer 150. The saline aquifer 150 is a subterranean geological feature that defines a void 152 that is at least partly filled with brine 154, and the depth is a distance away from the surface 101 relative to gravity In the illustrated example, the saline aquifer 150 is formed as a geological structure known as a trap. In the illustrated example, the saline aquifer 150 is illustrated as type of anticlinal trap, in which the rock strata have been pushed to form a generally domed shape, but in other examples the saline aquifer 150 can be formed as other types of traps (e.g., fault, stratigraphic).

An operator 105 can use a controller 172 and the carbon sequestration system 116 to control the deployment of the measurement tool 114 to the saline aquifer. The measurement tool 114 is deployed to multiple locations within the saline aquifer 150 to sample and determine (e.g., measure) the salinity of the brine 154 at various different locations and depths within the saline aquifer 150. Each salinity measurement is paired with a corresponding location (e.g., depth) value representative of the location within the saline aquifer from which the salinity measurement was derived and stored as a collection of salinity values.

The collection of salinity values 218 can be analyzed to generate a one-, two-, or three-dimensional model salinity within the saline aquifer 150. The collection of salinity values can also be analyzed to determine the presence or absence of a salinity gradient within the within the saline aquifer 150, which would be indicative of the presence or absence of leakage, and by extension, indicate if the saline aquifer 150 has a competent top seal that would make the saline aquifer 150 an appropriate candidate for use in carbon sequestration. If the saline aquifer 150 is found to be a good candidate, the carbon sequestration system 116 can be controlled (e.g., by the operator 105, by the controller 172) to deliver carbon (e.g., CO2) to the saline aquifer 150 for long-term storage. Examples of well-sealed and poorly sealed saline aquifers are discussed further in the descriptions of FIGS. 3A-4B.

Figure 2:
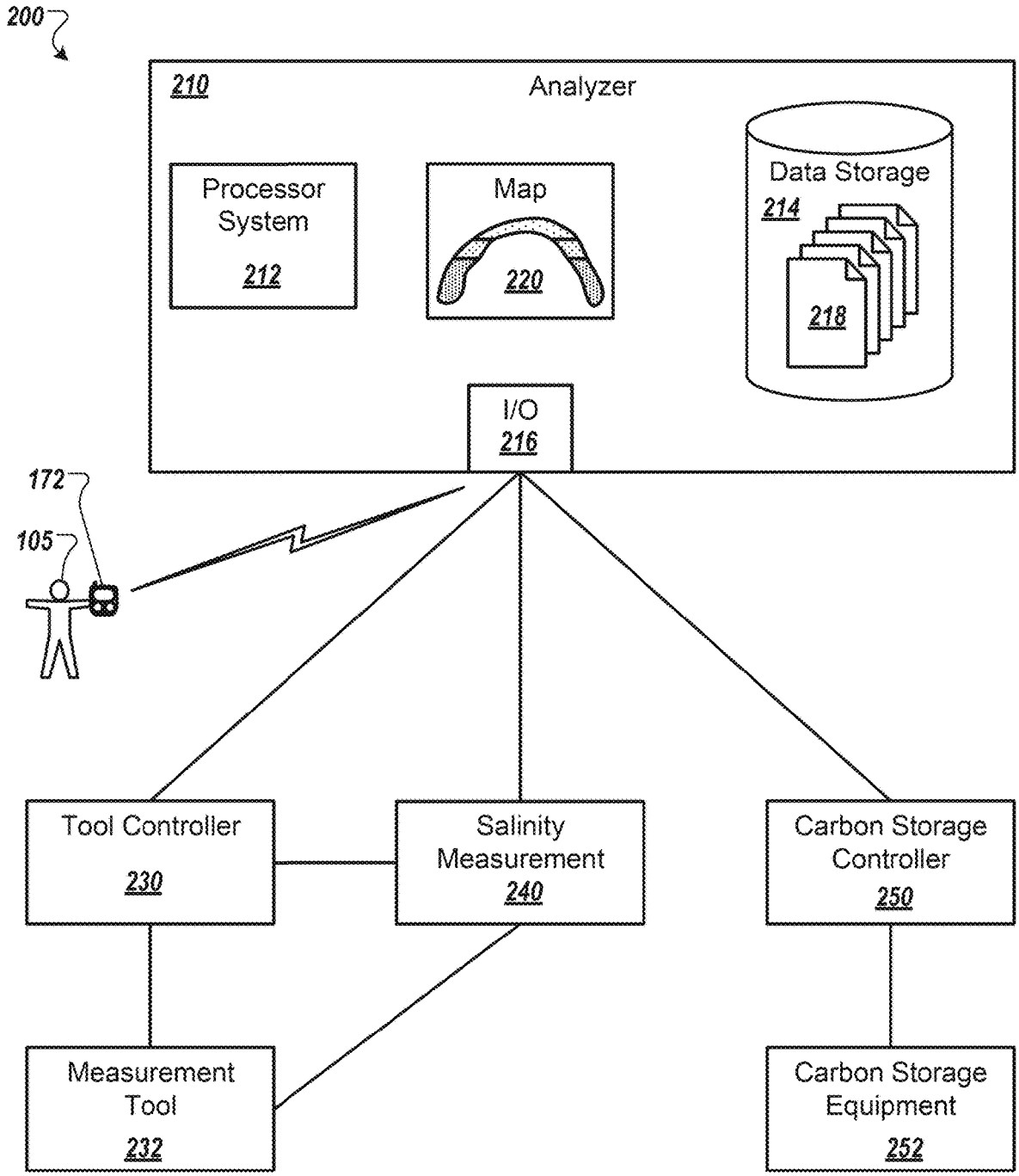
FIG. 2 is a block diagram that shows an example of a system for evaluating the suitability of identified geological structures for use in carbon capture and sequestration.

FIG. 2 is a block diagram that shows an example of a system 200 for evaluating the suitability of identified geological structures for use in carbon capture and sequestration. In some embodiments, the system 200 can be the example carbon sequestration system 116 of FIG. 1.

The system 200 includes an analyzer system 210 that includes a processor system 212, a storage system 214, and an input/output system 216. The storage system 214 is configured to store and provide access to a collection of salinity values 218. Each salinity value in the collection of salinity values 218 includes a salinity measurement value (e.g., a value representative of an amount of salinity, salt density, or total dissolved solids in a sample of water), and at least a depth value (e.g., a measured or determined value representative of a depth within an aquifer at which the salinity measurement value was measured, or a depth where the water sample that was analyzed to obtain the salinity measurement value was obtained).

The processor system 212 is configured to analyze the collection of salinity values 218 to form a map 220. The map 220 is a one-dimensional (e.g., a line), a two-dimensional (e.g., plane), or a three-dimensional (e.g., volumetric) model or representation of salinity levels at various locations within a saline aquifer, such as the example saline aquifer 150. Examples of maps of well-sealed and poorly sealed saline aquifers are discussed further in the descriptions of FIGS. 3A-4B.

The analyzer system 210 is configured to be controlled by the operator 105, either directly (e.g., through input and output devices connected directly to the analyzer system 210) or remotely, for example through the example controller 172. The analyzer system 210 is also configured to communicate with, and in some embodiments, control the operation of other devices.

In the illustrated example, the analyzer system 210 is configured to communicate with and control a tool controller 230. The tool controller 230 is configured to control the deployment of a measurement tool 232 to various depths and locations within a saline aquifer, obtain measurements of salinity levels or total dissolved solids (TDS) at those locations, and provide information about the salinities at the tool locations. In some embodiments, the tool controller 230 can direct deployment of the measurement tool 232 to various vertical depths away from the Earth's surface, or the tool controller 230 can direct deployment of the measurement tool 232 to various positions within the three-dimensional volume of the void 152.

In some embodiments, the measurement tool 232 can be the example measurement tool 114 of FIG. 1. For example, the tool controller 230 can control surface equipment to lower the measurement tool 114 from the drilling rig 110 down a well shaft to the saline aquifer 150. The tool controller 230 can cause the measurement tool 114 to be raised and lowered to measure the salinity or TDS of the brine 154 at different depths within the saline aquifer 150 and provide the obtained depth and salinity information to the analyzer system 210 for storage as part of the collection of salinity values 218.

In some embodiments, the measurement tool 232 or 114 can be a modular formation dynamic testing (MDT) tool. For example, the measurement tool 232 or 114 can be a wireline formation testing tool that can provide accurate measurements of formation pressure and permeability. It can also collect formation fluid samples for retrieval to the surface for additional analysis.

In some embodiments, the measurement tool 232 or 114 can be a drill stem test (DST) testing tool. For example, the measurement tool 232 or 114 can be a tool that evaluates geological features, such as the example saline aquifer 150, during the drilling of a well. The DST testing tool can be a temporary completion of the wellbore that provides information on whether to complete the well.

In the illustrated example, the analyzer system 210 is configured to communicate with and control a salinity measurement system 240. In some embodiments, the salinity measurement system 240 can be a stand-alone system, or it can be a component of the measurement tool 232. The salinity measurement system 240 is configured to measure the salinity or TDS of brine at deployed locations of the measurement tool 232. In some embodiments, the measurements can be made in-situ. For example, measurements can be taken in real-time as the measurement tool is positioned within the saline aquifer 150). In some embodiments, the measurements can be made of brine samples taken by the measurement tool 232 and then brought to the surface for later analysis by the salinity measurement system 240. The measured salinity or TDS levels are provided to the analyzer system 210 for storage as part of the collection of salinity values 218.

In the illustrated example, the analyzer system 210 is configured to communicate with and control a carbon storage controller 250. For example, the analyzer system 210 can determine that the saline aquifer 150 has a good top seal that presents a low risk of leakage, and therefore determine that the saline aquifer 150 may be a good candidate for carbon sequestration. Based on such a determination, the analyzer system 210 can send commands to the carbon storage controller 250 to begin a carbon sequestration process by controlling a collection of carbon storage equipment 252 (e.g., valves, pumps) or related equipment to direct carbon or carbon-based compounds (e.g., CO2) downhole to the saline aquifer 150 for long-term storage. In another example, the analyzer system 210 may determine that the saline aquifer 150 is not well sealed and presents a high risk of leakage, and therefore determine that the saline aquifer 150 may be a poor candidate for carbon sequestration. Based on such a determination, the analyzer system 210 can withhold commands to the carbon storage controller 250 to prevent carbon sequestration or send commands that cause the carbon storage controller 250 to control the collection of carbon storage equipment 252 or related equipment to prevent or halt the delivery of carbon or carbon-based compounds to the saline aquifer 150.

Figure 3A:
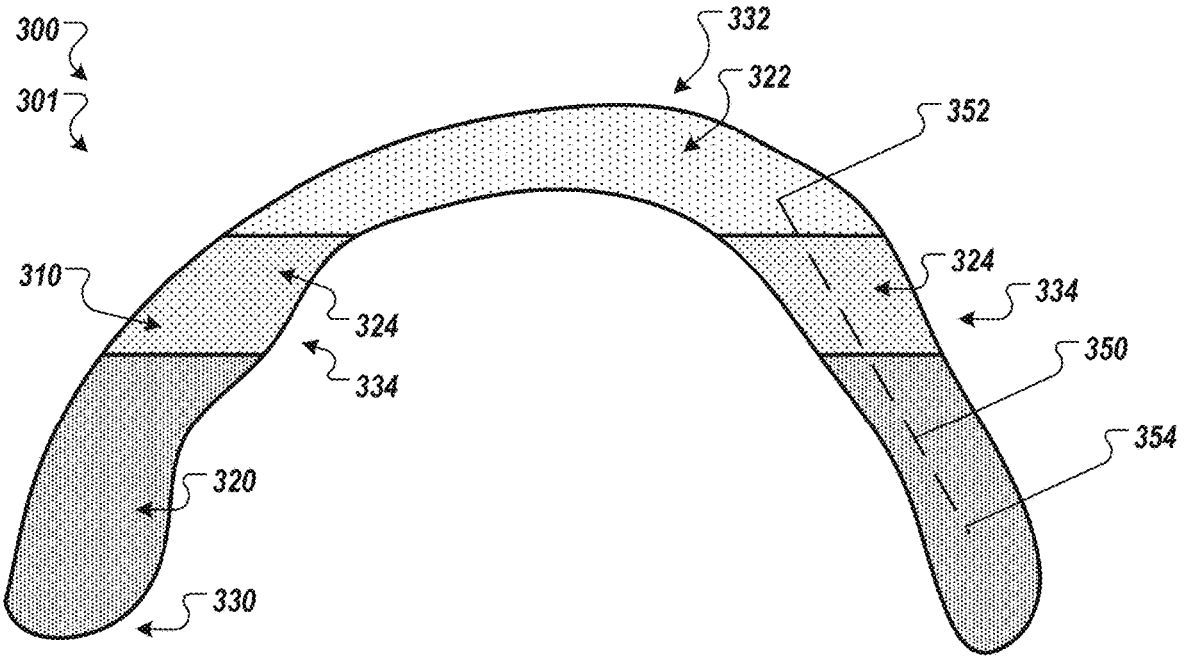
FIG. 3A is an example map of salinity levels in an example saline aquifer.

FIG. 3A is an example map 300 of salinity levels in an example saline aquifer 301 filled with a brine 310. In some embodiments, the saline aquifer 301 can be the example saline aquifer 150 of FIG. 1. In general, the saline aquifer 301 is an example of an aquifer with a competent top seal (e.g., the aquifer is well-sealed and has little or no leakage).

The distribution of salinity in a brine, such as the brine 310, is rarely ever perfectly homogenous. Some portions of the brine will have higher salt or TDS levels than other portions. Salt and other dissolved solids make water have a relatively greater weight per unit of volume than is found in relatively fresher water. In well-sealed aquifers, such as the saline aquifer 301, that have been sealed and left undisturbed for thousands or millions of years, more saline (and therefore denser) water 320 will settle toward deeper, lower regions 330 of the saline aquifer 301, away from the surface. Relatively fresher, less saline, and therefore less dense water 322 will rise toward higher, upper regions 332 of the saline aquifer 301. Water 324 of moderate salinity (e.g., between the highest salinities and lowest salinities within the saline aquifer 301) will have a moderate density and will settle at moderate, vertically central regions 334 of the saline aquifer 301 between the upper regions 332 and the lower regions 330.

The saline aquifer 301 is probed with a measurement tool such as the example measurement tool 114 of FIG. 1. Salinity levels at multiple locations within the saline aquifer 301 are measured and recorded (e.g., as the example collection of salinity values 218), and then used to generate the map 300 of the physical distribution of salinity within the saline aquifer 301.

Figure 3B:
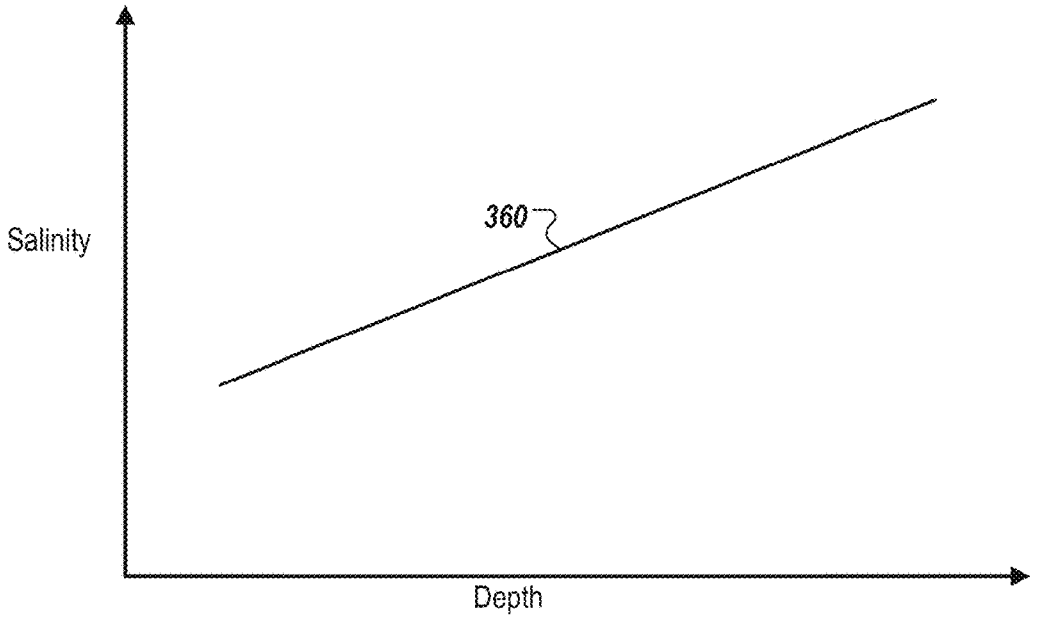
FIG. 3B is an example map of salinity levels in the example saline aquifer of FIG. 3A.

When an aquifer is well-sealed, saline levels will exhibit a gradient in which the salinity or TDS levels will be at a relative minimum level at relatively shallower locations, and the salinity will increase substantially smoothly with depth until the reach a substantially maximum level at relatively deeper locations. For example, saline levels taken along a path 350 between an upper location 352 and a lower location 354 will exhibit a predictable (e.g., linear, curved, exponential, logarithmic) increase in salinity or TDS. An example of such a salinity gradient 360 is shown in FIG. 3B.

When a salinity gradient is identifiable from the map 300, the saline aquifer 301 can be identified as lacking the currents that would otherwise disturb the smooth vertical distribution of salinity, which is a strong indicator that the saline aquifer 301 is well sealed (e.g., has a competent top seal) and not leaky. In some implementations, a well-sealed aquifer, as indicated by the presence of a salinity gradient such as the salinity gradient 360, can be interpreted as an indicator that the saline aquifer 301 may be a good candidate for carbon sequestration.

Figure 4A:
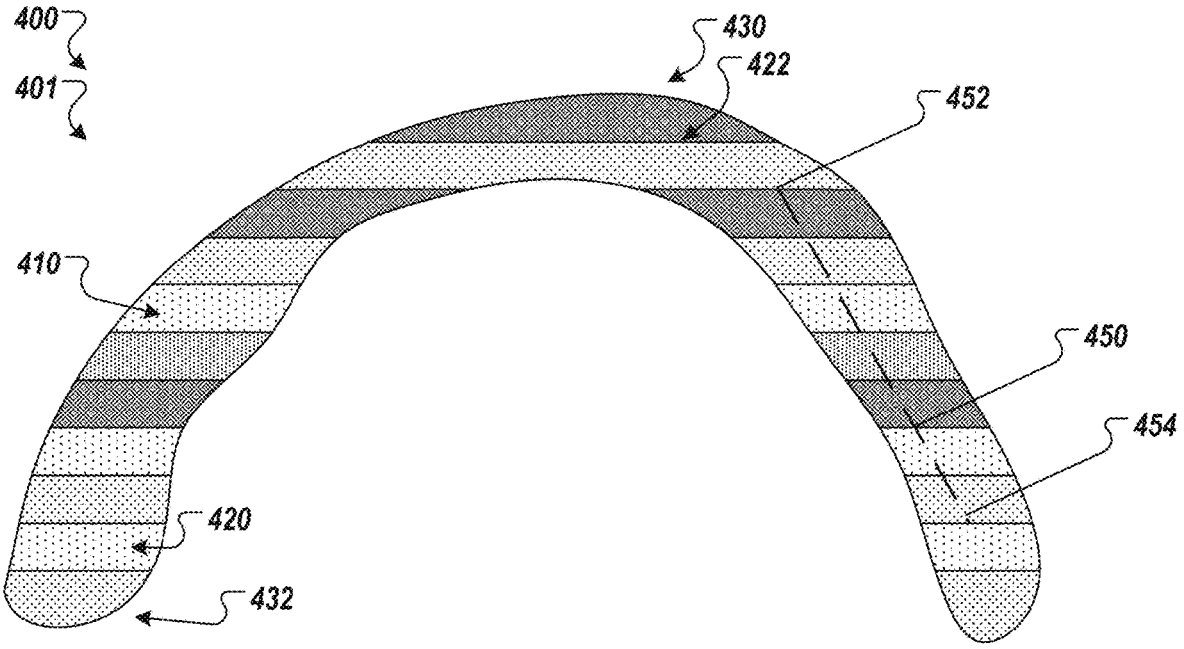
FIG. 4A is an example map of salinity levels in another example saline aquifer.

FIG. 4A is an example map 400 of salinity levels in an example saline aquifer 401 filled with a brine 410. In some embodiments, the saline aquifer 401 can be the example saline aquifer 150 of FIG. 1. In general, the saline aquifer 401 is an example of an aquifer with a poor top seal (e.g., the aquifer is poorly sealed and has leakage).

As discussed already, the distribution of salinity in a brine, such as the brine 410, is rarely ever perfectly homogenous. In poorly sealed aquifers, such as the saline aquifer 401, leakage will cause currents that can keep the distribution of salinity at least partly mixed or partly uniform. In such aquifers, water 420 having relatively low saline levels can be pushed toward relatively lower regions 432 of the saline aquifer 401, and relatively more saline (and therefore denser) water 422 can be pushed toward shallower upper regions 430 of the saline aquifer 401, closer to the surface. Water of different salinity levels can be found at various depths, without a clearly identifiable order or arrangement by density.

The saline aquifer 401 is probed with a measurement tool such as the example measurement tool 114 of FIG. 1. Salinity levels at multiple locations within the saline aquifer 401 are measured and recorded (e.g., as the example collection of salinity values 218), and then used to generate the map 400 of the physical distribution of salinity within the saline aquifer 401.

Figure 4B:
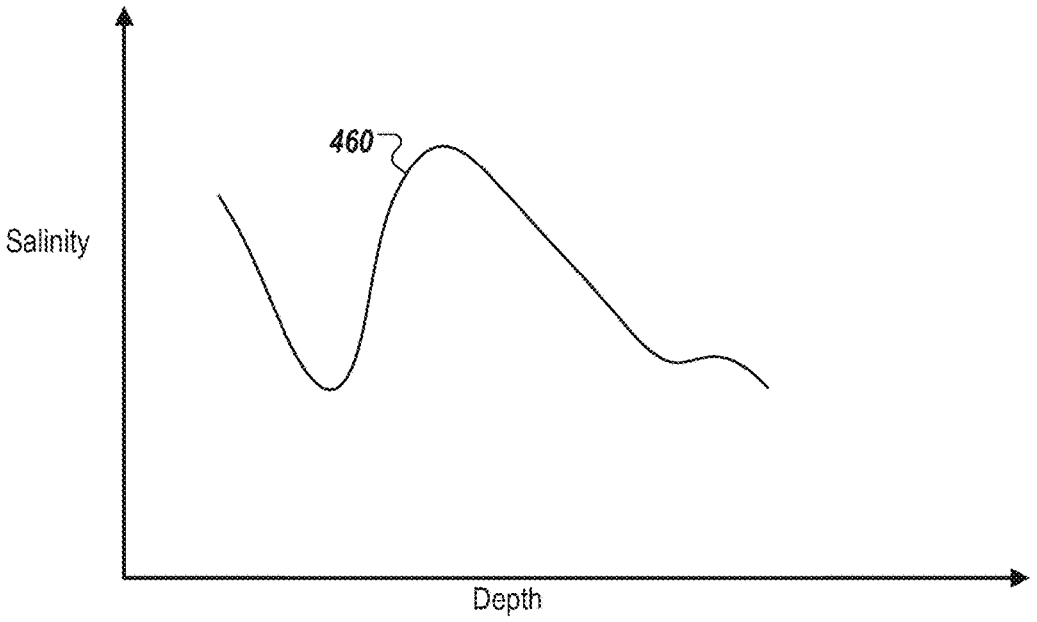
FIG. 4B is an example map of salinity levels in the example saline aquifer of FIG. 3A.

When an aquifer is poorly sealed, saline levels will not exhibit a gradient like the example salinity gradient 360 of FIG. 3B. Instead, salinity levels will lack a predictable or identifiable correlation with depth. For example, saline levels taken along a path 450 between an upper location 452 and a lower location 454 will exhibit a substantially random change in salinity or TDS relative to depth. An example of such an unpredictable salinity distribution 460 is shown in FIG. 4B.

When a salinity gradient is not identifiable from the map 400, the saline aquifer 401 can be identified as having currents that disturb the brine and the distribution of salinity within the saline aquifer 401, which is a strong indicator that the saline aquifer 401 is poorly sealed (e.g., lacks a competent top seal) and is leaky. In some implementations, a leaky aquifer, as indicated by the lack of an identifiable salinity gradient such as is shown in the salinity distribution 460, can be interpreted as an indicator that the saline aquifer 401 may be a risky candidate for carbon sequestration.

Figure 5:
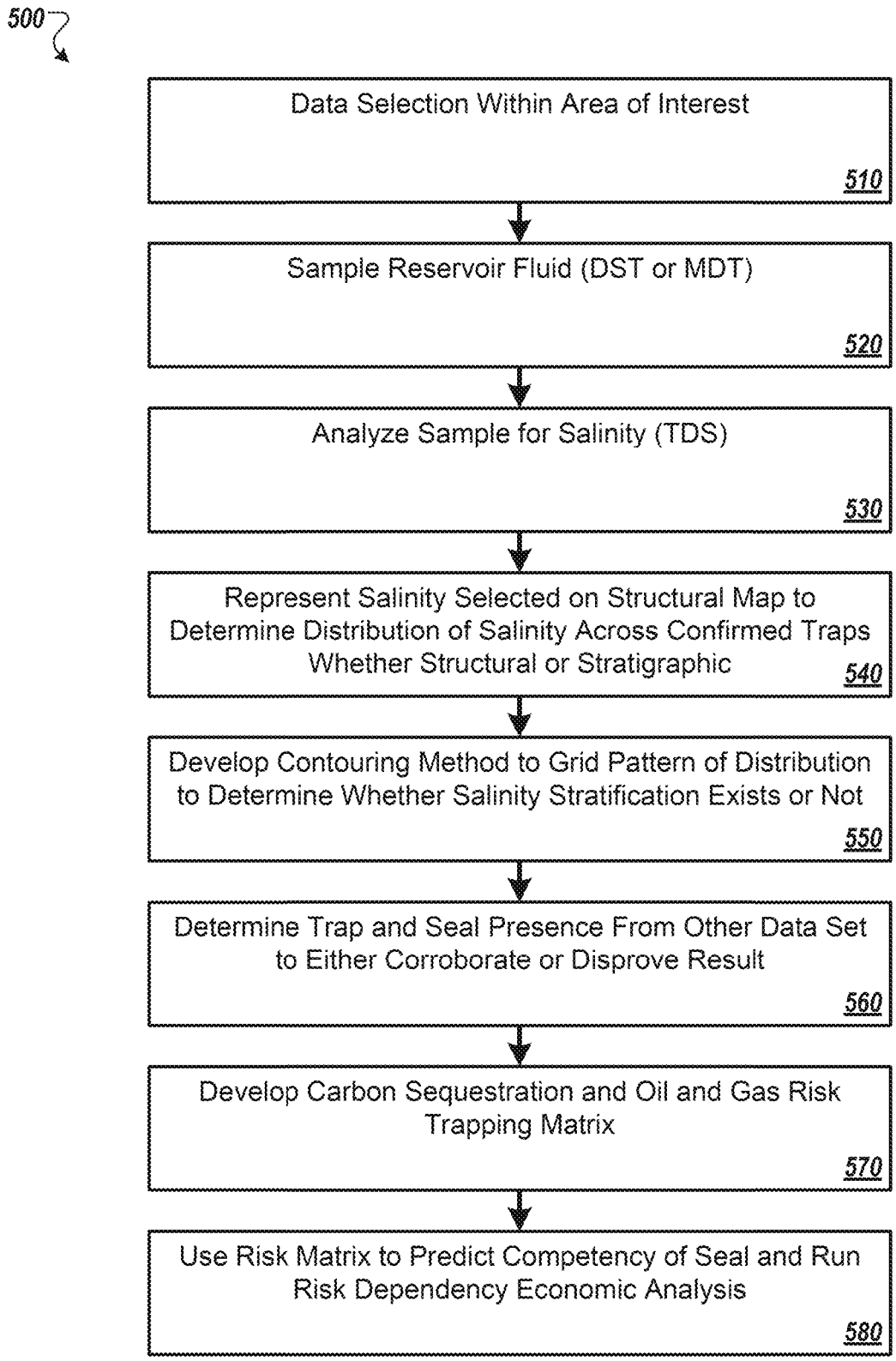
FIG. 5 is flow chart that shows an example of a process for evaluating the suitability of identified geological structures for use in carbon capture and sequestration.

FIG. 5 is flow chart that shows an example of a process 500 for evaluating the suitability of identified geological structures for use in carbon capture and sequestration. In some implementations, the process 500 can be performed by all or part of the example carbon sequestration system 116 or the example system 200.

At 510, data is selected from an area of interest (AOI) such as a saline aquifer (e.g., the example saline aquifers 150, 301, 401). For example, a data set may include data that describes a large geographic area that includes one or more saline aquifers, and the selected data can be a subset of data corresponding to a candidate aquifer.

At 520, reservoir fluid is sampled with a measurement tool, such as the example measurement tool 114 (e.g., DST, MDT). At 530, the sample is analyzed to measure the salinity or TDS of the sample. At 540, salinity is represented on a structural map (e.g., the example maps 300, 400) to determine a distribution of salinity or TDS across confirmed traps (e.g., structural, stratigraphic).

At 550, a contouring method is developed to grid the pattern of distribution to determine whether a salinity gradient (or stratification) exists or not. At 560, trap and seal presence are determined from other data sets to either corroborate or disprove the result of the contouring method. For example, four indices may be used in the evaluation of a candidate aquifer, and while the contouring method may provide a positive result, one, two, or three of the other indicators may contradict and possibly outweigh the positive result.

At 570, a carbon sequestration and oil and gas risk trapping matrix is developed. For example, a mathematical model of oil and gas risk trapping can be created based on and understating of the pattern of stratification of salinity within a reservoir or system.

At 580, the risk matrix is used to estimate or predict the competency of aquifer sealing and to run a risk dependency economic analysis. For example, the matrix can be used to estimate, predict, or determine the amount of CO2 that can be injected before the top seal is broken. Preventing injected CO2 leak-off is a primary objective of the predictability of the risk matrix and this affects the economic viability of the CO2 sequestration sink.

Figure 6:
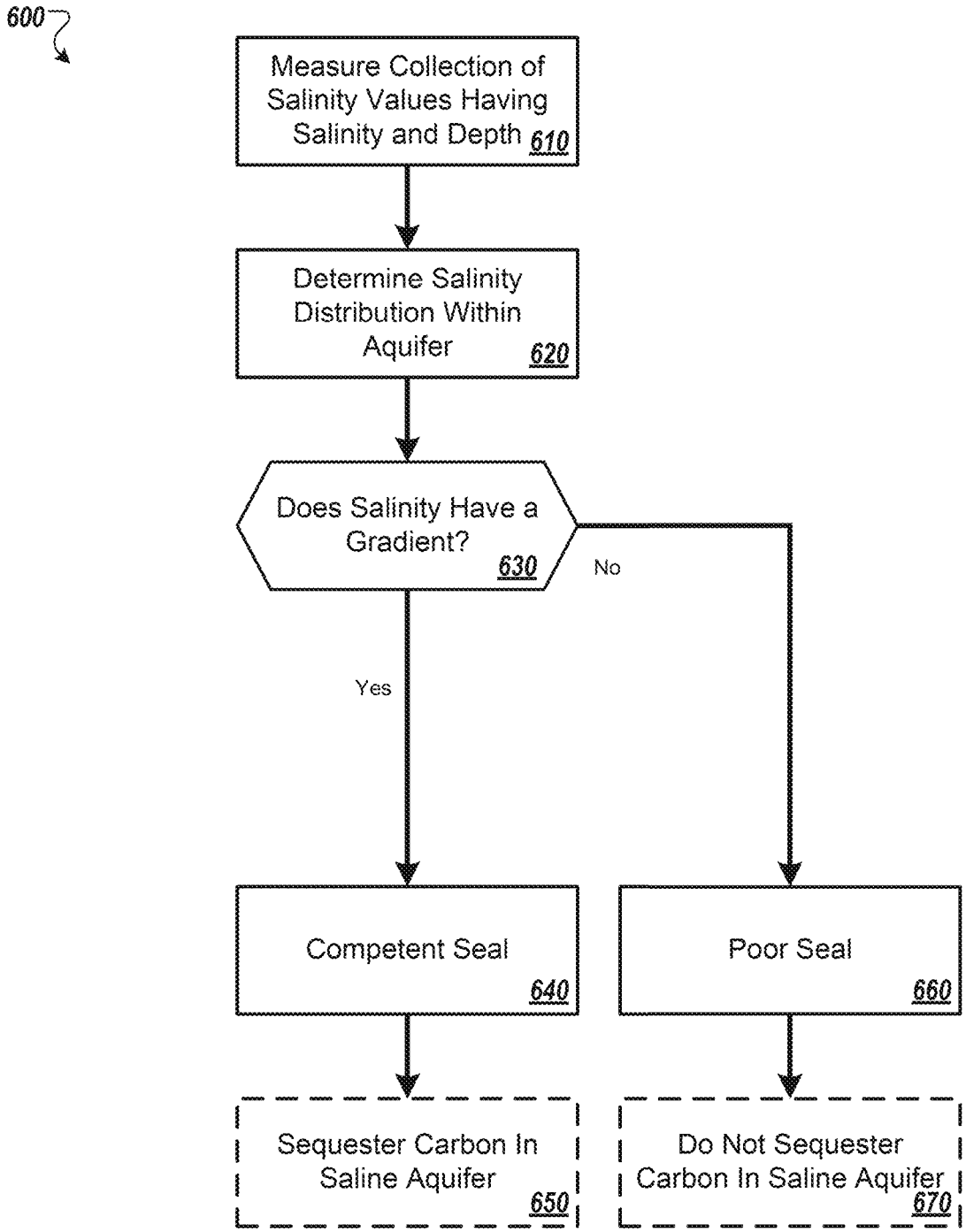
FIG. 6 is flow chart that shows another example of a process for evaluating the suitability of identified geological structures for use in carbon capture and sequestration.

FIG. 6 is flow chart that shows another example of a process 600 for evaluating the suitability of identified geological structures for use in carbon capture and sequestration, according to some implementations of the present disclosure. For clarity of presentation, the description that follows generally describes the process 600 in the context of the other figures in this description. For example, in some implementations the process 600 can be performed by all or part of the example carbon sequestration system 116 or the example system 200. However, it will be understood that the process 600 can be performed, for example, by any suitable system, environment, software, and hardware, or a combination of systems, environments, software, and hardware, as appropriate. In some implementations, various steps of process 600 can be run in parallel, in combination, in loops, or in any order.

At 610, a collection of salinity values is measured, each salinity value includes a depth value representative of a depth within a saline aquifer, in which the saline aquifer is a subterranean geological feature that defines a void at least partly filled with brine, and the depth is a distance away from an upper geological surface relative to gravity, and a salinity measurement value representative of salinity at the depth. For example, the example collection of salinity values 218 can be obtained from the example aquifer 150 of FIG. 1.

In some implementations, measuring the collection of salinity values further includes providing a measurement tool to a first depth within the saline aquifer, obtaining a first sample of brine from the first depth, measuring the first sample to determine a first salinity measurement value of a first salinity value, measuring the first depth to determine a first depth value of the first salinity value, providing the measurement tool to a second depth within the saline aquifer, obtaining a second sample of aquifer fluid from the second depth, measuring the second sample to determine a second salinity measurement value of a second salinity value, and measuring the second depth to determine a second depth value of the second salinity value. For example, the example measurement tool 114 of FIG. 1 can be deployed to multiple locations at multiple depths within the example saline aquifer 150 to obtain multiple salinity measurements and depth measurements that can be stored as the example collection of salinity values 218 and arranged as the example map 220. In some implementations, the measurement tool can be a modular formation dynamic testing (MDT) tool or a drill stem test (DST) testing tool.

From 610, the process 600 proceeds to 620.

At 620, a distribution of salinity across a collection of depths within the saline aquifer is determined based on the collection of salinity values. For example, the example map 220 of FIG. 2 can be generated based on the example collection of salinity values 218.

From 620, the process 600 proceeds to 630.

At 630, a determination is made. If a salinity gradient is identified between a shallow region within the saline aquifer defined between a first threshold depth and a second threshold depth, and a deep region within the saline aquifer defined by a third threshold depth and a fourth threshold depth deeper than the first threshold depth and the second threshold depth, and a collection of first salinity measurement values representative of the shallow region have salinity measurement values that are lower than salinity measurement values representative of the deep region, then the process proceeds to 640. For example, if the example salinity gradient 360 of FIG. 3B is identified based on the example map 300 of FIG. 3A, then the process 600 can process to 640.

In some implementations, identifying the salinity gradient can further include determining an absence of one or more regions within the saline aquifer in which salinity is higher at shallower depths than one or more other regions within the saline aquifer at lower depths. For example, the example map 300 of FIG. 3A has no detected regions within the example saline aquifer 301 in which salinity is higher at a shallow location than at a deeper location. By contrast, the example map 400 of FIG. 4A includes detected regions within the example saline aquifer 401 in which salinity is higher at a shallow location than at a deeper location.

In some implementations, identifying the salinity gradient can further include determining that a salinity difference between the shallow region and the deep region exceeds a predetermined salinity difference threshold value. Homogeneity of the distribution of salt density across an aquifer can be indicative of a poor seal, and even when a saline gradient is detected, an insufficient difference between the salinities at two identified depths may suggest the presence of leakage. As such, salinity values can be compared against a predetermined threshold to determine if a predetermined difference between salinity at an identified deep depth is sufficiently higher than salinity at an identified shallow depth to be indicative of a good seal. For example, the salinity measurement values from the example upper location 352 and the example lower location 354 can be compared, and if the difference in salinity meets or exceeds a predetermined minimum different threshold value, then the example gradient 360 is identified as being indicative of a competent top seal. If the difference in salinities was found to be too low, then that may be an indication of movement and stirring of the brine caused by leakage.

At 640, a sealing competency of the saline aquifer is determined based on the identified salinity gradient. For example, the identification or presence of the example salinity gradient 360 can suggest or indicate, alone or in combination with other indicators, that the example saline aquifer 301 is well sealed and substantially free of leaks.

From 640, in some implementations, the process 600 proceeds to 650.

At 650, carbon or carbon-based compounds are sequestered in the saline aquifer. For example, the example carbon sequestration system 116 of FIG. 1 can be controlled to direct carbon dioxide into the example saline aquifer 150.

If, however, at 630 a salinity gradient is not identified, then the process 600 can proceed to 660. For example, the example salinity distribution 460 of FIG. 4B does not exhibit a salinity gradient, so as a result the process 600 may proceed to 660.

At 660, a poor sealing of the saline aquifer is determined based on the absence of an identified salinity gradient. For example, the example salinity gradient 460 can suggest or indicate, alone or in combination with other indicators, that the example saline aquifer 401 of FIG. 4A is not well sealed and may have leaks.

From 660, in some implementations, the process 600 can proceed to 670.

At 670, carbon or carbon-based compounds are not sequestered in the saline aquifer. For example, the example carbon sequestration system 116 of FIG. 1 can be controlled to stop or prevent the delivery of direct carbon dioxide into the example saline aquifer 150.

In some implementations, the systems and techniques described herein can be used as part of a larger technique for evaluating the risk of carbon capture storage (CCS) prospects or sinks (e.g., risk matrix method) in an exploration phase to ascertain the viability and ability to effectively store CO2 in an identified reservoir.

A risk matrix can be used to score or otherwise quantify the suitability of an identified location for use in carbon sequestration. The risk matrix includes at least four elements that can be mathematically combined to produce an overall score for the location. These elements include a score of closure (e.g., trap, containment) presence (e.g., does the shape of the geology of an area support the presence of an appropriate trap or void), a score of reservoir presence (e.g., does the area have the right type of rock to host an appropriate trap or void), a score of CO2 injectivity potential (e.g., is the void filled with brine, or is it filled with fresh water or oil), and a score of closure (e.g., is the feature well-sealed and able to hold CO2 long term, based on the techniques described herein to identify saline gradients).

For example, a geological area can be analyzed and found to have a closure score of 0.8 (on a scale of 0 to 1) or 80%, a reservoir presence score of 0.8 or 80%, an injectivity potential of 0.5 or 50%, and a seal score of 0.7 or 70%. These four terms can be multiplied together to obtain a score of 0.22 or 22%, which is an indicator of the chance of successful storage of CO2 at the selected location.

Figure 7:
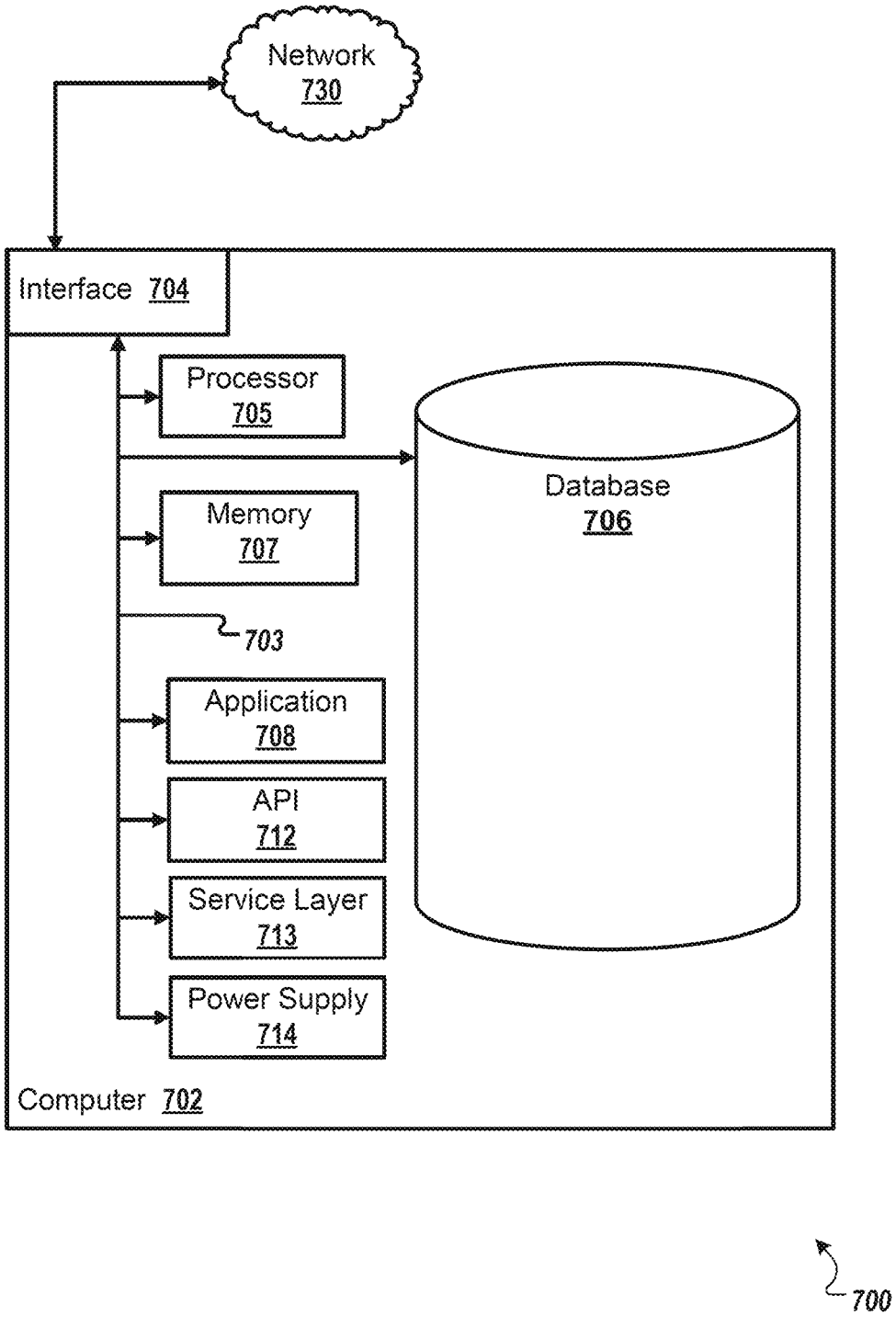
FIG. 7 is a block diagram illustrating an example computer system used to provide computational functionalities associated with described algorithms, methods, functions, processes, flows, and procedures as described in the present disclosure, according to some implementations of the present disclosure.

FIG. 7 is a block diagram of an example computer system 700 used to provide computational functionalities associated with described algorithms, methods, functions, processes, flows, and procedures described in the present disclosure, according to some implementations of the present disclosure. The illustrated computer 702 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 702 can include input devices such as keypads, keyboards, and touch screens that can accept user information. Also, the computer 702 can include output devices that can convey information associated with the operation of the computer 702. The information can include digital data, visual data, audio information, or a combination of information. The information can be presented in a graphical user interface (UI) (or GUI).

The computer 702 can serve in a role as a client, a network component, a server, a database, a persistency, or components of a computer system for performing the subject matter described in the present disclosure. The illustrated computer 702 is communicably coupled with a network 730. In some implementations, one or more components of the computer 702 can be configured to operate within different environments, including cloud-computing-based environments, local environments, global environments, and combinations of environments.

At a top level, the computer 702 is an electronic computing device operable to receive, transmit, process, store, and manage data and information associated with the described subject matter. According to some implementations, the computer 702 can also include, or be communicably coupled with, an application server, an email server, a web server, a caching server, a streaming data server, or a combination of servers.

The computer 702 can receive requests over network 730 from a client application (for example, executing on another computer 702). The computer 702 can respond to the received requests by processing the received requests using software applications. Requests can also be sent to the computer 702 from internal users (for example, from a command console), external (or third) parties, automated applications, entities, individuals, systems, and computers.

Each of the components of the computer 702 can communicate using a system bus 703. In some implementations, any, or all of the components of the computer 702, including hardware or software components, can interface with each other or the interface 704 (or a combination of both) over the system bus 703. Interfaces can use an application programming interface (API) 712, a service layer 713, or a combination of the API 712 and service layer 713. The API 712 can include specifications for routines, data structures, and object classes. The API 712 can be either computer-language independent or dependent. The API 712 can refer to a complete interface, a single function, or a set of APIs.

The service layer 713 can provide software services to the computer 702 and other components (whether illustrated or not) that are communicably coupled to the computer 702. The functionality of the computer 702 can be accessible for all service consumers using this service layer. Software services, such as those provided by the service layer 713, can provide reusable, defined functionalities through a defined interface. For example, the interface can be software written in JAVA, C++, or a language providing data in extensible markup language (XML) format. While illustrated as an integrated component of the computer 702, in alternative implementations, the API 712 or the service layer 713 can be stand-alone components in relation to other components of the computer 702 and other components communicably coupled to the computer 702. Moreover, any or all parts of the API 712 or the service layer 713 can be implemented as child or sub-modules of another software module, enterprise application, or hardware module without departing from the scope of the present disclosure.

The computer 702 includes an interface 704. Although illustrated as a single interface 704 in FIG. 7, two or more interfaces 704 can be used according to particular needs, desires, or particular implementations of the computer 702 and the described functionality. The interface 704 can be used by the computer 702 for communicating with other systems that are connected to the network 730 (whether illustrated or not) in a distributed environment. Generally, the interface 704 can include, or be implemented using, logic encoded in software or hardware (or a combination of software and hardware) operable to communicate with the network 730. More specifically, the interface 704 can include software supporting one or more communication protocols associated with communications. As such, the network 730 or the interface's hardware can be operable to communicate physical signals within and outside of the illustrated computer 702.

The computer 702 includes a processor 705. Although illustrated as a single processor 705 in FIG. 7, two or more processors 705 can be used according to particular needs, desires, or particular implementations of the computer 702 and the described functionality. Generally, the processor 705 can execute instructions and can manipulate data to perform the operations of the computer 702, including operations using algorithms, methods, functions, processes, flows, and procedures as described in the present disclosure.

The computer 702 also includes a database 706 that can hold data for the computer 702 and other components connected to the network 730 (whether illustrated or not). For example, database 706 can be an in-memory, conventional, or a database storing data consistent with the present disclosure. In some implementations, database 706 can be a combination of two or more different database types (for example, hybrid in-memory and conventional databases) according to particular needs, desires, or particular implementations of the computer 702 and the described functionality. Although illustrated as a single database 706 in FIG. 7, two or more databases (of the same, different, or combination of types) can be used according to particular needs, desires, or particular implementations of the computer 702 and the described functionality. While database 706 is illustrated as an internal component of the computer 702, in alternative implementations, database 706 can be external to the computer 702.

The computer 702 also includes a memory 707 that can hold data for the computer 702 or a combination of components connected to the network 730 (whether illustrated or not). Memory 707 can store any data consistent with the present disclosure. In some implementations, memory 707 can be a combination of two or more different types of memory (for example, a combination of semiconductor and magnetic storage) according to particular needs, desires, or particular implementations of the computer 702 and the described functionality. Although illustrated as a single memory 707 in FIG. 7, two or more memories 707 (of the same, different, or combination of types) can be used according to particular needs, desires, or particular implementations of the computer 702 and the described functionality. While memory 707 is illustrated as an internal component of the computer 702, in alternative implementations, memory 707 can be external to the computer 702.

The application 708 can be an algorithmic software engine providing functionality according to particular needs, desires, or particular implementations of the computer 702 and the described functionality. For example, application 708 can serve as one or more components, modules, or applications. Further, although illustrated as a single application 708, the application 708 can be implemented as multiple applications 708 on the computer 702. In addition, although illustrated as internal to the computer 702, in alternative implementations, the application 708 can be external to the computer 702.

The computer 702 can also include a power supply 714. The power supply 714 can include a rechargeable or non-rechargeable battery that can be configured to be either user- or non-user-replaceable. In some implementations, the power supply 714 can include power-conversion and management circuits, including recharging, standby, and power management functionalities. In some implementations, the power-supply 714 can include a power plug to allow the computer 702 to be plugged into a wall socket or a power source to, for example, power the computer 702 or recharge a rechargeable battery.

There can be any number of computers 702 associated with, or external to, a computer system containing computer 702, with each computer 702 communicating over network 730. Further, the terms "client," "user," and other appropriate terminology can be used interchangeably, as appropriate, without departing from the scope of the present disclosure. Moreover, the present disclosure contemplates that many users can use one computer 702 and one user can use multiple computers 702.

Described implementations of the subject matter can include one or more features, alone or in combination.

For example, in a first implementation, a method includes: measuring a collection of salinity values, each salinity value including a depth value representative of a depth within a saline aquifer, in which the saline aquifer is a subterranean geological feature that defines a void at least partly filled with brine, and the depth is a distance away from an upper geological surface relative to gravity, and a salinity measurement value representative of salinity at the depth, determining, based on the collection of salinity values, a distribution of salinity across a plurality of depths within the saline aquifer, identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region, and determining, based on the identified salinity gradient, a sealing competency of the saline aquifer.

The foregoing and other described implementations can each, optionally, include one or more of the following features:

A first feature, combinable with any of the following features, the method further including: providing a measurement tool to a first depth within the saline aquifer, obtaining a first sample of brine from the first depth, measuring the first sample to determine a first salinity measurement value of a first salinity value, measuring the first depth to determine a first depth value of the first salinity value, providing the measurement tool to a second depth within the saline aquifer, obtaining a second sample of aquifer fluid from the second depth, measuring the second sample to determine a second salinity measurement value of a second salinity value, and measuring the second depth to determine a second depth value of the second salinity value.

A second feature, combinable with any of the previous or following features, where the measurement tool includes a modular formation dynamic testing (MDT) tool.

A third feature, combinable with any of the previous or following features, wherein the measurement tool includes a drill stem test (DST) testing tool.

A fourth feature, combinable with any of the previous or following features, where identifying the salinity gradient further includes determining an absence of one or more regions within the saline aquifer in which salinity is higher at shallower depths than one or more other regions within the saline aquifer at lower depths.

A fifth feature, combinable with any of the previous or following features, where identifying the salinity gradient further comprises determining that a salinity difference between the shallow region and the deep region exceeds a predetermined salinity difference threshold value.

A sixth feature, combinable with any of the previous or following features, where identifying wherein identifying the salinity gradient further includes determining that the shallow region and the deep region are separated by a distance that exceeds a predetermined depth difference threshold value A seventh feature, combinable with any of the previous or following features, where the method further includes sequestering, based on the determining, at least one of carbon or a carbon-based compound in the saline aquifer.

In a second implementation, a non-transitory, computer-readable medium storing one or more instructions executable by a computer system to perform operations including: measuring a collection of salinity values, each salinity value including a depth value representative of a depth within a saline aquifer, in which the saline aquifer is a subterranean geological feature that defines a void at least partly filled with brine, and the depth is a distance away from an upper geological surface relative to gravity, and a salinity measurement value representative of salinity at the depth, determining, based on the collection of salinity values, a distribution of salinity across a plurality of depths within the saline aquifer, identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region, and determining, based on the identified salinity gradient, a sealing competency of the saline aquifer.

The foregoing and other described implementations can each, optionally, include one or more of the following features:

A first feature, combinable with any of the following features, where the system further includes a measurement tool, and the operations further include providing a measurement tool to a first depth within the saline aquifer, obtaining a first sample of brine from the first depth, measuring the first sample to determine a first salinity measurement value of a first salinity value, measuring the first depth to determine a first depth value of the first salinity value, providing the measurement tool to a second depth within the saline aquifer, obtaining a second sample of aquifer fluid from the second depth, measuring the second sample to determine a second salinity measurement value of a second salinity value, and measuring the second depth to determine a second depth value of the second salinity value.

A second feature, combinable with any of the previous or following features, where the measurement tool comprises a modular formation dynamic testing (MDT) tool.

A third feature, combinable with any of the previous or following features, where the measurement tool comprises a drill stem test (DST) testing tool.

A fourth feature, combinable with any of the previous or following features, where identifying the salinity gradient further comprises determining an absence of one or more regions within the saline aquifer in which salinity is higher at shallower depths than one or more other regions within the saline aquifer at lower depths.

A fifth feature, combinable with any of the previous or following features, where identifying wherein identifying the salinity gradient further comprises determining that a salinity difference between the shallow region and the deep region exceeds a predetermined salinity difference threshold value.

A sixth feature, combinable with any of the previous or following features, where the operations further comprise controlling, based on the determining, sequestration of at least one of carbon or a carbon-based compound in the saline aquifer.

In a third implementation a non-transitory computer-readable storage medium storing one or more instructions executable by a computer system to perform operations including: receiving a collection of salinity values, each salinity value including: a depth value representative of a depth within a saline aquifer, in which the saline aquifer is a subterranean geological feature that defines a void at least partly filled with brine, and the depth is a distance away from an upper geological surface relative to gravity, and a salinity measurement value representative of salinity at the depth, determining, based on the collection of salinity values, a distribution of salinity across a plurality of depths within the saline aquifer, identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region, and determining, based on the identified salinity gradient, a sealing competency of the saline aquifer.

The foregoing and other described implementations can each, optionally, include one or more of the following features:

A first feature, combinable with any of the following features, where the operations further comprise collecting the plurality of salinity values by measuring a first salinity at a first depth in the saline aquifer and measuring a second salinity at a second depth in the saline aquifer.

A second feature, combinable with any of the previous or following features, the operations further include providing a measurement tool to a first depth within the saline aquifer, obtaining a first sample of brine from the first depth, measuring the first sample to determine a first salinity measurement value of a first salinity value, measuring the first depth to determine a first depth value of the first salinity value, providing the measurement tool to a second depth within the saline aquifer, obtaining a second sample of aquifer fluid from the second depth, measuring the second sample to determine a second salinity measurement value of a second salinity value, and measuring the second depth to determine a second depth value of the second salinity value.

A third feature, combinable with any of the previous or following features, where the measurement tool comprises a modular formation dynamic testing (MDT) tool.

A fourth feature, combinable with any of the previous or following features, where the measurement tool comprises a drill stem test (DST) testing tool.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random-access memory (RAM), read-only memory (ROM), phase change memory (PRAM), static random-access memory (SRAM), dynamic random-access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touchscreen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A method for determining saline aquifer sealing competency, the method comprising:

measuring a plurality of salinity values, the measuring comprising:

providing a measurement tool to a first depth within the saline aquifer;

obtaining a first sample of brine from the first depth;

measuring the first sample to determine a first salinity measurement value of a first salinity value;

measuring the first depth to determine a first depth value of the first salinity value;

providing the measurement tool to a second depth within the saline aquifer;

obtaining a second sample of aquifer fluid from the second depth;

measuring the second sample to determine a second salinity measurement value of a second salinity value; and measuring the second depth to determine a second depth value of the second salinity value, wherein each salinity value comprises:

a depth value representative of a depth within a saline aquifer, in which the saline aquifer is a subterranean geological feature that defines a void at least partly filled with brine, and the depth is a distance away from an upper geological surface relative to gravity; and a salinity measurement value representative of salinity at the depth;

determining, based on the plurality of salinity values, a distribution of salinity across a plurality of depths within the saline aquifer;

identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region; and determining, based on the identified salinity gradient, a sealing competency of the saline aquifer.

2. The method of claim 1, wherein the measurement tool comprises a modular formation dynamic testing (MDT) tool.

3. The method of claim 1, wherein the measurement tool comprises a drill stem test (DST) testing tool.

4. The method of claim 1, wherein identifying the salinity gradient further comprises determining an absence of one or more regions within the saline aquifer in which salinity is higher at shallower depths than one or more other regions within the saline aquifer at lower depths.

5. The method of claim 1, wherein identifying the salinity gradient further comprises determining that a salinity difference between the shallow region and the deep region exceeds a predetermined salinity difference threshold value.

6. The method of claim 1, wherein identifying wherein identifying the salinity gradient further comprises determining that the shallow region and the deep region are separated by a distance that exceeds a predetermined depth difference threshold value.

7. The method of claim 1, further comprising sequestering, based on the determining, at least one of carbon or a carbon-based compound in the saline aquifer.

8. A computer-implemented system for determining saline aquifer sealing competency, the system comprising:

a measurement tool;

one or more processors; and a non-transitory computer-readable storage medium coupled to the one or more processors and storing programming instructions for execution by the one or more processors, the programming instructions instructing the one or more processors to perform operations comprising:

measuring a plurality of salinity values, wherein the measuring comprises:

providing a measurement tool to a first depth within the saline aquifer;

obtaining a first sample of brine from the first depth;

measuring the first sample to determine a first salinity measurement value of a first salinity value;

measuring the first depth to determine a first depth value of the first salinity value;

providing the measurement tool to a second depth within the saline aquifer;

obtaining a second sample of aquifer fluid from the second depth;

measuring the second sample to determine a second salinity measurement value of a second salinity value; and measuring the second depth to determine a second depth value of the second salinity value, wherein each salinity value comprises:

a depth value representative of a depth within a saline aquifer, in which the saline aquifer is a subterranean geological feature that defines a void at least partly filled with brine, and the depth is a distance away from an upper geological surface relative to gravity; and a salinity measurement value representative of salinity at the depth;

determining, based on the plurality of salinity values, a distribution of salinity across a plurality of depths within the saline aquifer;

identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region; and determining, based on the identified salinity gradient, a sealing competency of the saline aquifer.

9. The system of claim 8, wherein the measurement tool comprises a modular formation dynamic testing (MDT) tool.

10. The computer-implemented system of claim 8, wherein the measurement tool comprises a drill stem test (DST) testing tool.

11. The system of claim 8, wherein identifying the salinity gradient further comprises determining an absence of one or more regions within the saline aquifer in which salinity is higher at shallower depths than one or more other regions within the saline aquifer at lower depths.

12. The system of claim 8, wherein identifying wherein identifying the salinity gradient further comprises determining that a salinity difference between the shallow region and the deep region exceeds a predetermined salinity difference threshold value.

13. The system of claim 8, wherein the operations further comprise controlling, based on the determining, sequestration of at least one of carbon or a carbon-based compound in the saline aquifer.

14. A non-transitory, computer-readable medium storing one or more instructions executable by a computer system to perform operations comprising:

receiving a plurality of salinity values, the receiving comprising:

providing a measurement tool to a first depth within a saline aquifer;

obtaining a first sample of brine from the first depth;

measuring the first sample to determine a first salinity measurement value of a first salinity value;

measuring the first depth to determine a first depth value of the first salinity value;

providing the measurement tool to a second depth within the saline aquifer;

obtaining a second sample of aquifer fluid from the second depth;

measuring the second sample to determine a second salinity measurement value of a second salinity value; and measuring the second depth to determine a second depth value of the second salinity value, each salinity value comprising:

a depth value representative of a depth within the saline aquifer, in which the saline aquifer is a subterranean geological feature that defines a void at least partly filled with brine, and the depth is a distance away from an upper geological surface relative to gravity; and a salinity measurement value representative of salinity at the depth;

determining, based on the plurality of salinity values, a distribution of salinity across a plurality of depths within the saline aquifer;

identifying, based on the distribution of salinity, a salinity gradient between a shallow region within the saline aquifer defined between a first threshold depth and a second threshold depth, and a deep region within the saline aquifer defined by a third threshold depth and a fourth threshold depth deeper than the first threshold depth and the second threshold depth, wherein a collection of first salinity measurement values representative of the shallow region have salinity measurement values that are lower than salinity measurement values representative of the deep region; and determining, based on the identified salinity gradient, a sealing competency of the saline aquifer.

15. The medium of claim 14, wherein the measurement tool comprises a modular formation dynamic testing (MDT) tool.

16. The medium of claim 14, wherein the measurement tool comprises a drill stem test (DST) testing tool.

* * * * *